United States Patent [19]

Orr, Jr. et al.

[11] 4,229,615

[45] Oct. 21, 1980

[54] ROUND/FLAT WOVEN MULTI-CONDUCTOR CABLE

[75] Inventors: Lawrence W. Orr, Jr., Simpsonville; Edgar A. Ross, Greenville, both of S.C.

[73] Assignee: Southern Weaving Company, Greenville, S.C.

[21] Appl. No.: 924,366

[22] Filed: Jul. 13, 1978

[51] Int. Cl.[3] ..... H01B 7/04

[52] U.S. Cl. ..... 174/117 M; 174/72 A; 174/116; 174/117 F

[58] Field of Search ..... 174/72 A, 117 M, 116, 174/117 F, 117 R

[56] References Cited

U.S. PATENT DOCUMENTS

| | | | |
|---|---|---|---|
| 473,352 | 4/1892 | Sawyer | 174/117 F |
| 2,155,060 | 4/1939 | Phillips | 174/117 F |
| 2,531,958 | 11/1950 | Williams | 174/117 M |
| 3,128,214 | 4/1964 | Lay | 174/72 A |
| 3,607,490 | 9/1971 | Heinzmann | 174/116 X |
| 3,627,903 | 12/1971 | Plummer | 174/117 M |
| 3,900,508 | 9/1975 | Ross | 174/117 M |
| 3,984,622 | 10/1976 | Ross | 174/117 M |
| 4,095,042 | 6/1978 | Ross | 174/117 F |

FOREIGN PATENT DOCUMENTS

| | | | |
|---|---|---|---|
| 1229394 | 4/1971 | United Kingdom | 174/72 A |

*Primary Examiner*—Richard R. Kucia

*Attorney, Agent, or Firm*—Bailey, Dority & Flint

[57] ABSTRACT

A woven electrical multi-conductor cable is disclosed having alternating longitudinal sections having generally flat and round configurations wherein the flat section affords binding of the conductors in fixed locations for convenient termination and uni-directional routing and wherein conductors are harnessed in the round section in random order for gimbal flexibility affording omni-directional routing of the cable in the round section.

4 Claims, 9 Drawing Figures

ROUND/FLAT WOVEN MULTI-CONDUCTOR CABLE

BACKGROUND OF THE INVENTION

In many applications of woven multi-conductor cables such as missile and tele-communication system applications, the placement during routing and termination of the multi-conductor cable in a minimum of space is a problem to which considerable attention need be given. While flat cable configurations have been known to provide fixed location of the conductors therein, their use has been limited by their inherent inflexibility in the lateral direction and are susceptible to abrasion. Round cables in which the cables are randomly located are flexible and offer good protection against abrasion but have been expensive to manufacture, particularly where special configuration of the conductors is required to afford accurate termination.

Accordingly, an important object of the present invention is the provision of a continuously woven multi-conductor cable having alternating flat and round sections affording versatility in routing, placement and termination.

Another important object of the present invention is to provide a woven cable which can easily and economically be manufactured which provides highly flexible routing in a minimum of space and accurate termination of the conductors.

Yet another important object of the present invention is the provision of a continuously woven multi-conductor cable having alternating round and flat longitudinal sections whereby the conductors are loosely and randomly harnesses for omni-directional routing in the round section and in which the conductors are bound in fixed locations in the flat section affording uni-directional routing and accuracy in terminal connection in close spaces.

Still another important object of the present invention is the provision of a woven multi-conductor cable having a woven cover by which conductors may be bound in alternating flat and round sections to afford versatility in routing and in termination.

SUMMARY OF THE INVENTION

It has been found that a multi-conductor continuously woven electrical cable having versatility in routing and affording accurate termination can be had by arranging a plurality of elongated conductors in longitudinally extending manner and interweaving a continuous fill strand and a plurality of warp strands about the conductors to form continuously woven alternating generally round and flat sections. A first longitudinal section of the cable having a generally round configuration includes the warp strands interwoven with the fill strand forming a harness loosely and randomly binding the conductors affording a high degree of gimbal flexibility for omni-directional routing of the cable. At least one second longitudinal section of the cable has a generally flat configuration with the fill strand woven across the top and bottom thereof including at least a portion of the warp strands of the first section interwoven as warp binders between the top and bottom runs of the fill strand and between adjacent conductors fixing the location of the conductors and binding the second section in the flat configuration providing uni-directional flexibility.

An alternate construction, suitable where less stringent binding and covering is required, includes a fill strand woven in a twill weave pattern in the flat section which is then broken out of the weave and wrapped around the conductors in a loose random arrangement to harness the conductors and accomplish the round section.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
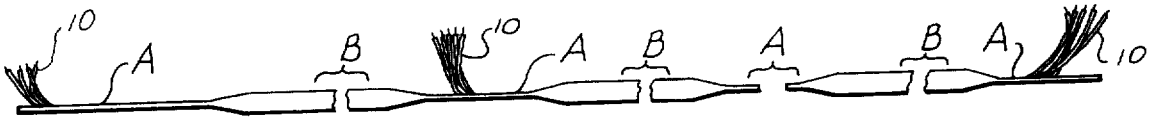
FIG. 1 is a schematic elevation of a woven cable constructed according to the invention continuously woven in alternate flat and round sections.
Figure 2:
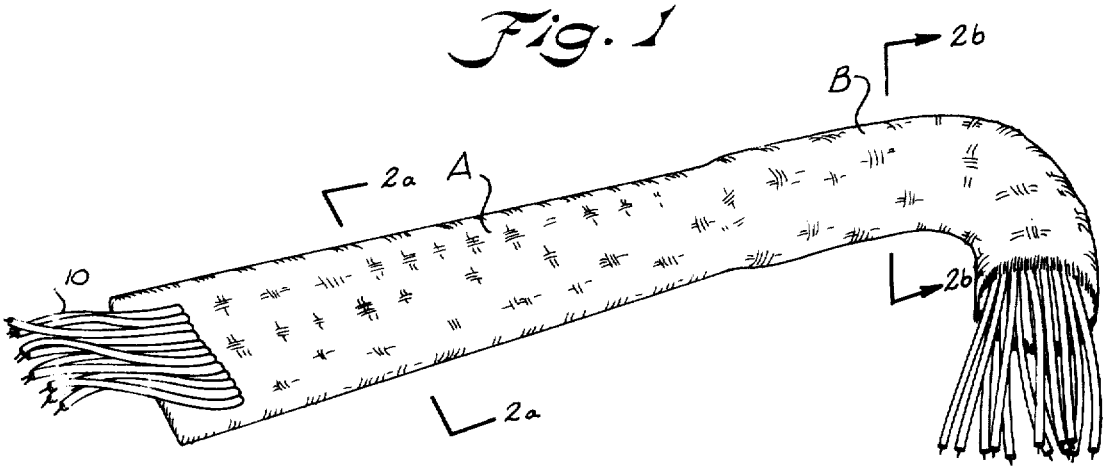
FIG. 2 is a perspective view illustrating the general configuration of flat and round sections of the cable of FIG. 1 having a plain weave cover according to the invention.

A woven multi-conductor cable is illustrated having generally flat sections A and round sections B in which a plurality of elongated conductors 10 are arranged in a longitudinally extending manner. In FIG. 2, a woven cover C is illustrated having a plain weave pattern formed from a plurality of warps 12 and 12*a* interwoven with a continuous fill strand 14. The warps and fill may be any suitable fibrous material such as NOMEX brand nylon. In section B, the cover C is formed such that the warp strands 12 and fill strand 14 form a generally loose cover harnessing the conductors 10 in random locations resulting in gimbal flexibility which allows the cable to be flexed freely in any direction. In section A, a number of the warp strands 12 denoted particularly as 12*a* are broken out of the cover weave and are woven between top and bottom runs, 14*a* and 14*b*, respectively, of the fill strand and between adjacent conductors to bind the conductors in a generally flat configuration and fix their locations therein. The flat section facilitates accurate terminations in a minimum of space. The conductors lie generally side-by-side in a common plane affording uni-directional cable flexing primarily back and forth in the conductor plane. The flat section may be advantageously utilized there flexing in one direction only is required and/or where a longitudinal section having a round configuration may not be accommodated due to a narrow space.

Conductors 10 typically consist of conductor wire coated with an insulation layer and twisted pairs or any other number of conductors may be utilized between adjacent warp binder strands 12*a*.

Figure 3:
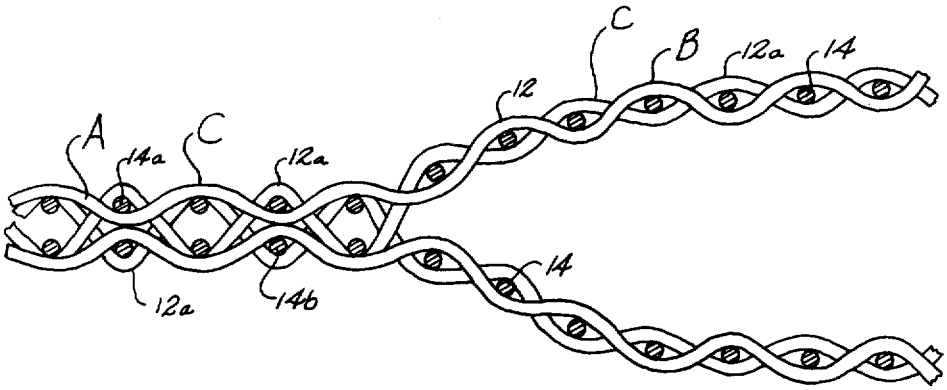
FIG. 3 is a side elevation schematically illustrating the weaving pattern of a woven cover according to the invention with the conductors omitted.
Figure 2B:
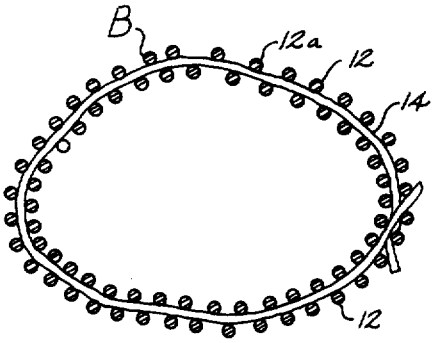
FIG. 2*b* is a sectional view taken along line 2*b* of FIG. 2.
Figure 2C:
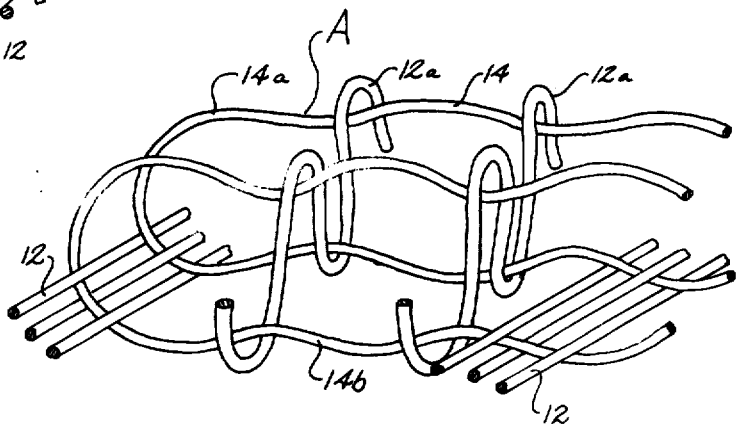
FIG. 2*c* is a perspective view illustrating in schematic form the woven cover of the present invention in the flat section thereof.
Figure 2A:
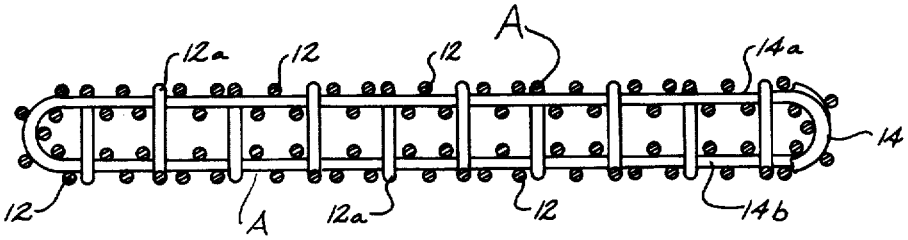
FIG. 2*a* is a sectional view taken along line 2*a* of FIG. 2.

FIGS. 2*a–c* and 3 illustrate the woven cable with conductors omitted for the sake of clarity. FIG. 2*b* illustrates the cover in the generally round section as including warp strands 12 and 12*a* interwoven with fill strand 14 in a plain weave configuration. Of course, section B will not have a fixed shape such as section A but by round or generally round it is meant that the conductors are harnessed together in some closed cross-sectional shape which at times may be irregular tubular or oval, etc. FIG. 2*a* illustrates a cross-section of flat section A wherein warp strands 12*a* are broken out of the cover and woven as binders between top and bottom runs or picks of the fill strand 14*a* and 14*b*, respectively. In FIG. 3, the woven interface between the round and flat sections are illustrated.

Figure 4:
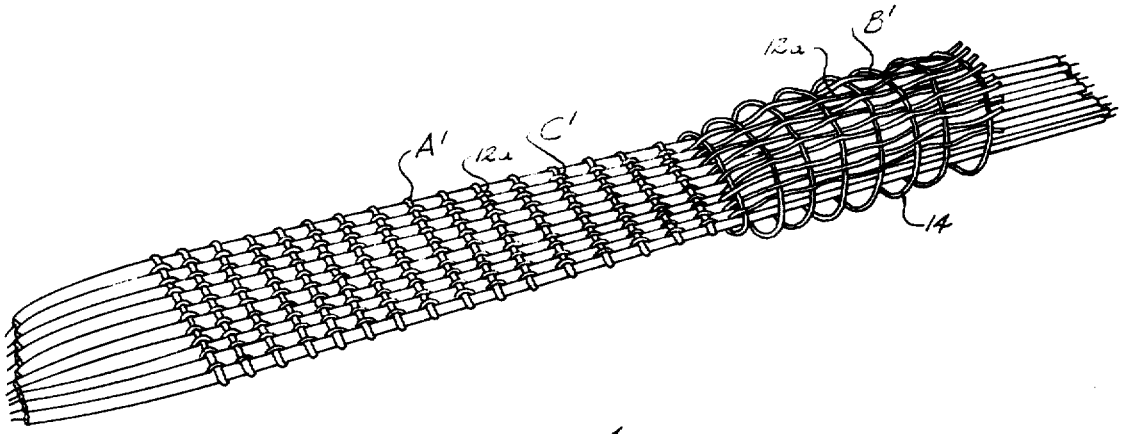
FIG. 4 is a perspective view illustrating another embodiment of a woven multi-conductor cable according to the invention.
Figure 5:
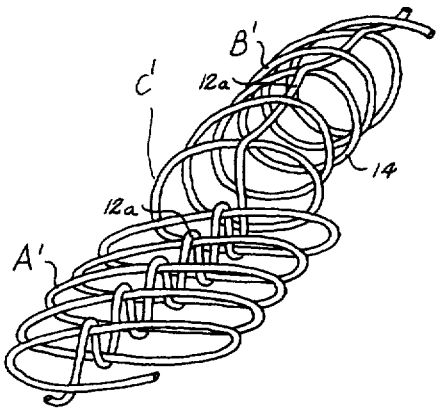
FIG. 5 is a perspective view illustrating schematically the weave pattern of the cable of FIG. 4 with conductors omitted.

FIG. 4 illustrates an alternate embodiment of the invention wherein flat and round sections A' and B' correspond to previously described sections A and B. The difference being the omission of cover warps 12 in both sections A' and B'. Thus, the cover C' in round section B' includes warps 12*a* interwoven with fill strand 14 and all warps 12*a* serve as binders in the flat section A' there being no plain weave cover in section A' and only a sparse plain weave cover in Section B'. The transition between and sections again being accomplished as illustrated in FIG. 3 with warp strands 12*a* weaving alternately between top and bottom runs of the fill strand 14*a* and 14*b* and between adjacent conductors 10 as best illustrated in FIG. 5. Such can also be visualized by omitting warps 12 from FIGS. 2*a*-2*c* and 3.

Figure 6:
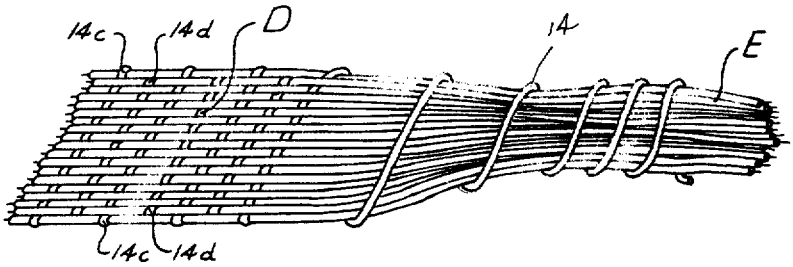
FIG. 6 is a perspective view illustrating another embodiment of a round/flat woven multi-conductor cable according to the invention.

FIG. 6 illustrates another embodiment of the invention wherein alternate flat and round sections D and E, respectively, are accomplished without the use of any cover warps 12 or binder warps 12*a*. Instead, the fill strand 14 is interwoven in a twill weave pattern in the flat section D with the conductors 10 serving as the warps. In this embodiment, the fill strand is woven alternately over and under adjacent conductors in a first pick 14*c* and on the return pick 14*d* are staggered in their alternate over and under pattern such that the fill strand passes under the conductor instead of over the same conductor as in the previous pick. In the transition between flat and round sections, the fill strands 14 is broken out and wrapped around the conductors 10 arranged loosely. Thus, the conductors are bound in a generally flat configuration in section D with the location of the conductors being fixed and are arranged in a bundle having a round or tubular configuration in the section E in which 360 degrees of flexibility of the conductors is afforded.

It is to be understood that the number and longitudinal dimensions of alternate round and flat sections may be varied to meet the routing, placement, abrasion, and termination requirements and that the conductors may be terminated from the round section as well as the flat such as where connection to a round terminal connector is desired.

Thus, it can be seen that an advantageous construction for a multi-conductor cable can be had according to the invention having continuously woven alternating flat and round sections of longitudinal conductors. In the flat section, the conductors are arranged in a generally flat side-by-side configuration wherein their location is fixed facilitating accurate programmed terminal connections. The flat longitudinal section may be strapped to flat surfaces and utilized for narrow spaces and where flexing in one direction from the plane of the conductors only is required. The round section accommodates a generally loose bundle of randomly located wires which may be gimbaled in essentially 360 degrees of direction for omni-directional routing.

The cable cover is continuously woven to form flat and round sections as required for a particular application with the total routing versatility exceeding that of prior multi-conductor cables.

While a preferred embodiment of the invention has been described using specific terms, such description is for illustrative purposes only, and it is to be understood that changes and variations may be made without departing from the spirit and scope of the following claims.

What is claimed is:

1. A woven electrically conductive cable comprising:

a plurality of elongated conductors arranged longitudinally extending in said cable;

a continuous fill strand woven about said conductors;

a plurality of warp strands interwoven with said fill strand;

a first longitudinal section of said cable including said warp strands interwoven with said fill strands forming a cover loosely and randomly harnessing said conductors affording a high degree of flexibility for omni-directional routing of said cable in said first section; and a second longitudinal section of said cable being continuously woven from said first section and having a generally flat configuration with said fill strand woven across the top and bottom thereof in alternating runs including at least a portion of said warp strands of said first section interwoven as warp binders between top and bottom runs of said fill strand and between conductors fixing the location of said conductors and binding said second section in said flat configuration and affording unidirectional flexibility.

2. The structure of claim 1 wherein said portion of said warp strands interwoven as warp binders in said second section includes all of said plurality of said warp strands in said first section.

3. A woven electrically condutive cable comprising:

a plurality of elongated conductors arranged longitudinally extending in said cable;

a continuous fill strand woven about said conductors;

a plurality of warp strands interwoven with said fill strand and said conductors;

a first longitudinal section of said cable including said warp strands interwoven with said fill strand forming a substantially solid outer cover loosely and randomly harnessing said conductors disposed in a random arrangement affording a high degree of omnidirectional flexibility for routing of said cable;

a second longitudinal section of said cable wherein said conductors are disposed in a generally side-by-side arrangement;

said second section being continuously woven from said first section and having a generally flat configuration with said fill strand passing across the top and bottom thereof in alternating picks being interwoven with a number of said warp strands which form said cover of said first section;

said number of said warp strands and said fill strand forming a substantially solid outer cover surrounding said conductors in said second section; and a remainder of said warp strands which form said first section cover being woven between said top and bottom picks of said fill strand and between adjacent conductors in said second section binding and fixing the location of said conductors therein.

4. A woven electrically conductive cable comprising:

a plurality of elongated conductors arranged in a longitudinally extending manner;

a continuous fill strand woven about said conductors;

a first section of said cable having a generally tubular configuration wherein said fill strand is woven around said conductors maintaining said conductors bound in a generally loose configuration relative to one another and randomly located affording gambal flexing of said cable in said first section for omni-directional routing of said cable;

a second section of said cable being continuously woven from said first section and having a generally flat configuration wherein said fill strand is interwoven with said cnductors binding said conductors in a generally side-by-side configuration, said conductors having an essentially fixed location in said first section, said first section having mainly uni-directional flexibility; and said cable having alternating first and second sections and terminating in one or the other for making desired terminal connections.

* * * * *